US007192189B2

(12) United States Patent
Baur et al.

(10) Patent No.: US 7,192,189 B2
(45) Date of Patent: Mar. 20, 2007

(54) PORTABLE INDUSTRIAL X-RAY SYSTEM CONVENIENTLY FIELD-CONFIGURABLE FOR GAS OR LIQUID COOLING

(75) Inventors: Gerald Baur, Danbury, CT (US); Donald Sharpe, Woodbury, CT (US)

(73) Assignee: Hologic, Inc., Bedford, MA (US)

( * ) Notice: Subject to any disclaimer, the term of this patent is extended or adjusted under 35 U.S.C. 154(b) by 0 days.

(21) Appl. No.: 11/066,749

(22) Filed: Feb. 25, 2005

(65) Prior Publication Data

US 2006/0029185 A1 Feb. 9, 2006

Related U.S. Application Data

(60) Provisional application No. 60/547,713, filed on Feb. 25, 2004.

(51) Int. Cl.
*H01J 35/10* (2006.01)

(52) U.S. Cl. ..... 378/199; 378/200

(58) Field of Classification Search ..... 378/119, 378/125–144, 199, 200
See application file for complete search history.

(56) References Cited

U.S. PATENT DOCUMENTS

| | | | | |
|---|---|---|---|---|
| 6,412,979 | B1 * | 7/2002 | Hell et al. | 378/200 |
| 6,519,317 | B2 * | 2/2003 | Richardson et al. | 378/130 |
| 6,674,838 | B1 * | 1/2004 | Barrett | 378/125 |
| 7,056,017 | B2 * | 6/2006 | Daniel et al. | 378/200 |

* cited by examiner

*Primary Examiner*—Edward J. Glick
*Assistant Examiner*—Irakli Kiknadze
(74) *Attorney, Agent, or Firm*—Cooper & Dunham LLP

(57) ABSTRACT

An x-ray system with a tubehead that can be easily configured in the field for gas or liquid cooling of the x-ray tube anode so a user need not stock or carry more than one kind of tubehead to accommodate different cooling needs.

6 Claims, 3 Drawing Sheets

PORTABLE INDUSTRIAL X-RAY SYSTEM CONVENIENTLY FIELD-CONFIGURABLE FOR GAS OR LIQUID COOLING

CROSS REFERENCE TO RELATED APPLICATION

This application claims the benefit of U.S. Provisional Application No. 60/547,713 filed Feb. 25, 2004, the entire contents of which are incorporated by reference herein.

FIELD

This patent specification is in the field of industrial x-ray systems that typically are used for non-destructive testing (NDT), for example of vehicles, pipes, and other objects.

BACKGROUND AND SUMMARY

Industrial x-ray systems have long been used in a number of fields, including NDT. Typically, they comprise several units: a tubehead that includes an x-ray tube, a cooling arrangement to remove heat from the x-ray tube, a source of electrical power, and a control unit. The x-ray tube typically includes a target that generates x-rays when bombarded with an electron beam accelerated between a cathode and an anode. The anode can be the target itself, or another material interposed between the anode and the cathode can be the target. ("Anode" here includes both an anode serving as the target and the combination of separate target material and the anode.) The anode gets heated in the process of generating x-rays, and typically needs to be cooled for practical operation.

One common type of cooling is gas cooling. Typically, a finned heat sink is thermally coupled with the anode and is cooled with gas such as air blown through the fins with a high capacity muffin fan. The gas cooling unit is affixed at the anode end of the tubehead. Another common type of cooling is liquid cooling. A fitting with an internal conduit is thermally coupled with the anode and liquid from an outside source is circulated through the fitting. In some cases, air cooling is preferable, as it does not require an outside source of liquid and a pump and thus fewer components need to be moved and set up. In other cases, liquid cooling is preferable, for example when operating the x-ray systems in volatile gas environments where there is a danger from possible sparking at the fan motor. In such environments, the outside source of liquid coolant and the pump can be spaced from the tubehead such that they are outside the volatile gas environment.

LORAD of Danbury Conn., a division of Hologic, Inc. of Bedford, Mass., has been selling x-ray systems for a number of years in this country with gas cooling as well as x-ray systems with liquid cooling. A number of other companies also have offered system with one type of cooling of the other type. For example, LORAD currently offers gas cooled tubeheads and also liquid cooled tubeheads under the commercial designation LORAD LPX series. However, to the inventors' knowledge, x-ray tubeheads that can be conveniently configured in the field to use either type of cooling have not been commercially available.

The inventors believe that it would be desirable to provide a tubehead that can be easily configured in the field to be either liquid cooled or air cooled. For example, when it is not known ahead of time in what environment a tubehead will have to operate, currently a user may need to stock, or take on a trip, both a gas cooled x-ray system and a liquid cooling system. The inventors believe that cost savings and convenience can be achieved by providing a single tubehead that can operate with either type of cooling and is easily configured in the field to change from one type of cooling to another.

DETAILED DESCRIPTION OF THE PREFERRED EMBODIMENTS

Figure 1:
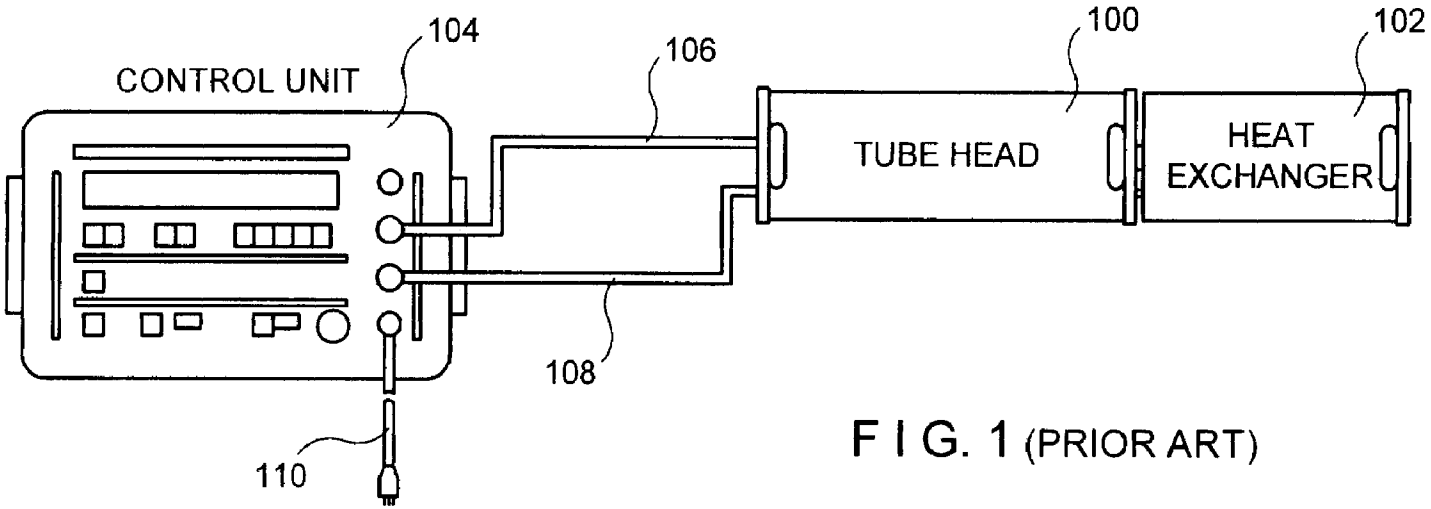
FIG. 1 (PRIOR ART)
FIG. 1 illustrates a prior art gas cooled x-ray system.

FIG. 1 illustrates a prior art air cooled x-ray system comprising a tubehead 100 and a heat exchanger 102. A control unit 104 communicates with tubehead 100 and gas heat exchanger 102 via cables 106 and 108 and is powered via cable 110 from a source such as an electric generator or a the power grid.

Figure 2:
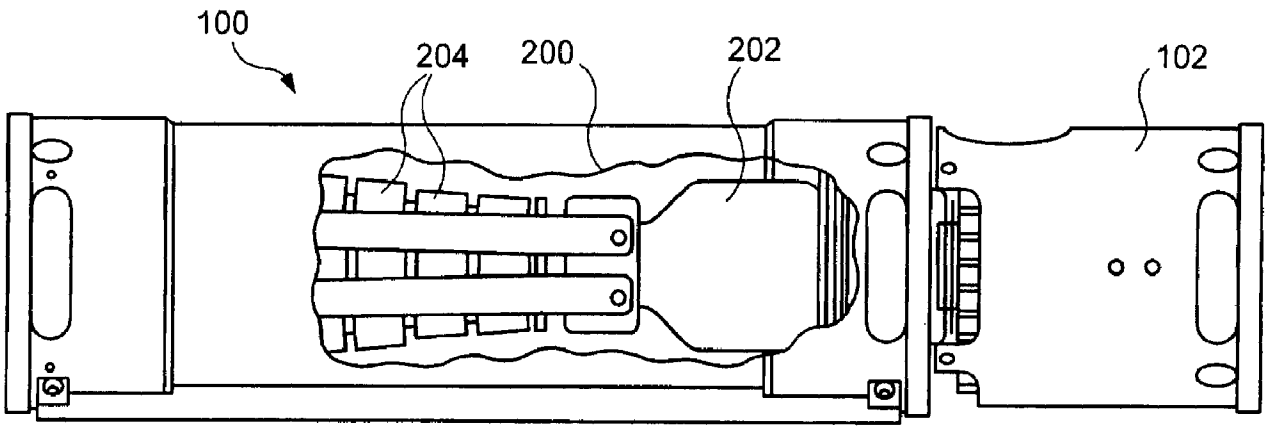
FIG. 2 (PRIOR ART)
FIG. 2 illustrates a portion of the system.

FIG. 2 illustrates a part of the interior of tubehead 100, shrouded by a housing 202 around an x-ray tube 202 and an internal power supply 204 that generates the high voltage needed to operate the x-ray tube. A muffin fan inside gas heat exchanger is driven by an internal electric motor to blow gas (e.g. air) through a finned heat sink that also in inside heat exchanger 102.

Figure 3:
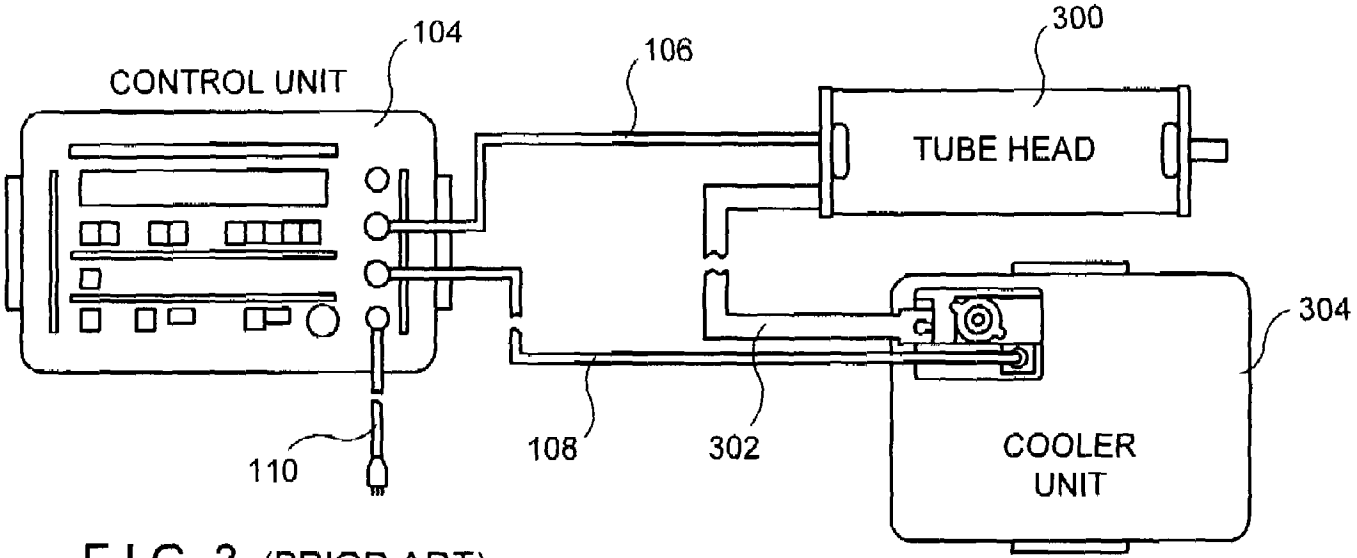
FIG. 3 (PRIOR ART)
FIG. 3 illustrates a prior art liquid cooled x-ray system.

FIG. 3 illustrates a prior art system that uses liquid cooling rather than gas cooling. A liquid cooled tubehead 300 connects through twin hose 302 to a cooler unit 304 that houses a supply of cooling liquid and a pump to circulates the liquid through a conduit thermally coupled to the anode of the x-ray tube in tubehead 300. A control unit 104 that can be the same as in FIG. 1 (or specially adapted for liquid cooling) connects to 300 via a cable 106 and with cooler unit 304 via cable 108, and to power via cable 110. The cables can be the same as the cables in FIG. 1 or can be specially adapted to liquid cooling.

Figure 4:
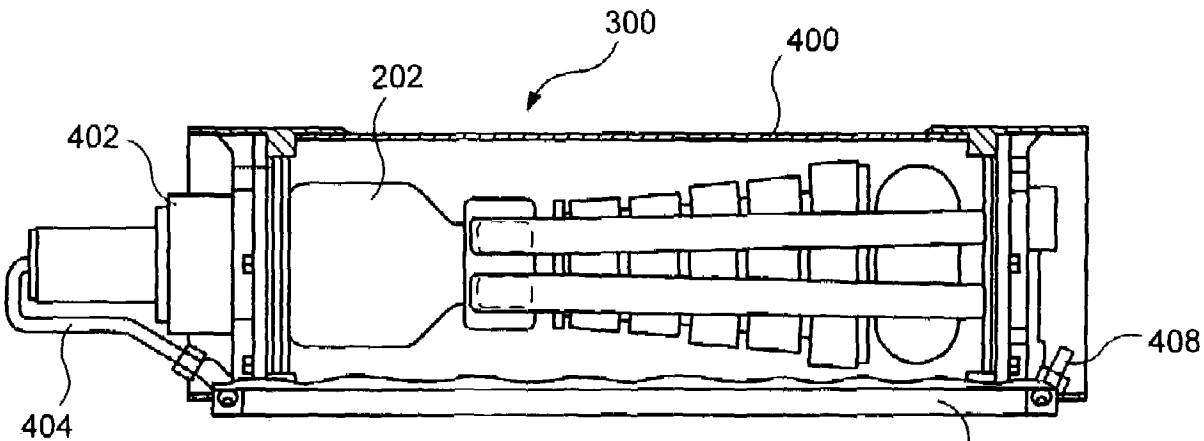
FIG. 4 (PRIOR ART)
FIG. 4 illustrates a portion of the system.

FIG. 4 illustrates liquid cooled tubehead 300 in partial section, showing a housing 400 around x-ray tube that can be the same as in FIG. 2 or can be specially adapted for liquid cooling. An anode (no visible in this FIG.) extends to the left in FIG. 4 and a fitting 402, made of a material such as brass, is secured in thermal contact with the anode to cool it with a liquid entering and exiting an internal conduit via tubes 404 and a manifold 406 with connectors 408 that couple to twin hose 302 and thus with cooler unit 304 (FIG. 3). In operation, cooler unit 304 pumps liquid coolant though the internal conduit in fitting 402 to cool the anode.

Figure 5:
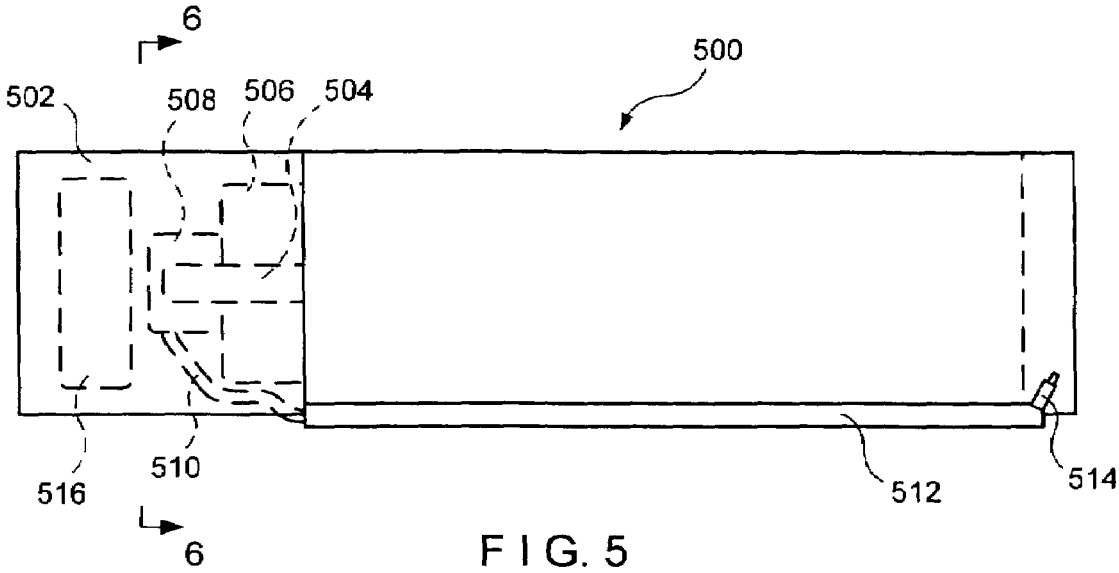
FIG. 5 illustrates a new x-ray tubehead that can be easily configured in the field for gas or liquid cooling.

FIG. 5 illustrates schematically a new arrangement in which tubehead 500 is easily field-configured for either gas or liquid cooling. Tubehead 500 cart use the same x-ray tube as in FIGS. 2 and 4, but has attached thereto a different heat exchanger 502 that selectively provides either gas cooling or liquid cooling. The x-ray tube has an anode 504 that extends to the left in FIG. 5 and typically is made mainly of a metal such as copper (but includes a target of a different metal, such as tungsten). A finned heat sink 506 fits tightly over and is in good thermal contact with anode 504. A fitting 508 that has an internal conduit for cooling liquid also is fits tightly over and is in good thermal contact with anode 504. Inlet and outlet conduits 510 circulate cooling liquid through the internal conduit of fitting 508, via manifold 512 that can connect through connectors 514 to twin hose 302 (FIG. 3) and thus to cooler unit 304. Heat sink 506 can be similar to the heat sink used in the gas cooled prior art heat exchangers offered by Lorad, except that it allows for conduits 510 to pass to fitting 508 and for also placing fitting 508 over anode 504. Fitting 508 can he similar to fitting 402 (FIG. 4) used in the prior art liquid cooled tubehead offered by Lorad, except for a different connection to conduits 510 (as illustrated in FIG. 5) and for an allowance for placing heat sink 506 on the same anode 504. To the left of fitting 508, the new unit uses a muffin fan 516 driven by an internal electric motor that can be same or similar to the fan and motor used in the prior art Lorad gas heat exchanger 102 (FIGS. 1 and 2). To simplify the drawing, details such inlets and outlets for air, cable connections, and details of how tubes 510 connect to manifold 512, are not shows in FIG, 5.

Figure 6:
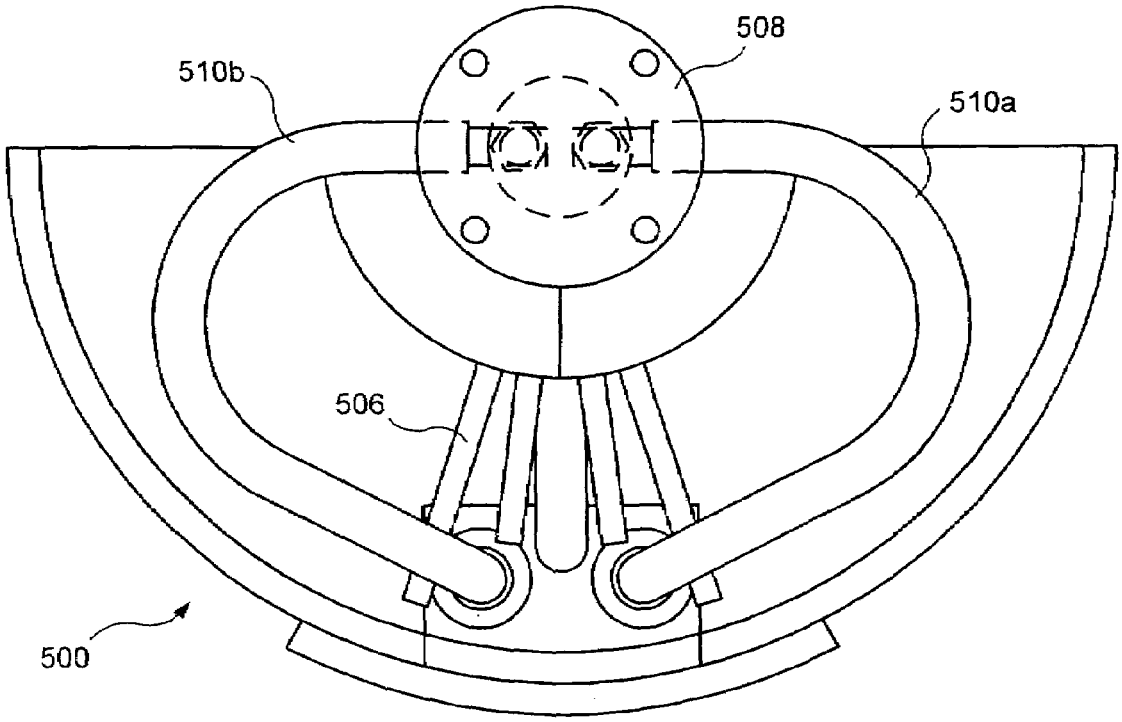
FIG. 6 illustrates a sectional view thereof.

FIG. 6 illustrates a section of FIG. 6 taken along lines 6—6, and shows inlet and outlet tubes 510 (labeled 510*a* and 510*b*) connected to fitting 508 to circulate cooling liquid through its internal conduit, and also show several of the fins of heat sink 506. Only two longer and two shorter fins are shown, although in fact the fins radiate symmetrically around the entire circumference of the heat sink. The two central fins are shorter to allow for passage of tubes 510.

In operation, if the user elects to use gas heating, fan 516 is turned on and blows cooling gas (air) at finned heat sink 506 to cool the heat sink and thereby anode 504. No liquid need circulate though fitting 508, and there is no need for twin hose 302 to be connected to connectors 514 or for cooler unit 304 to be available. If the user elects to use liquid cooling, the motor inside fan 516 remains turned off. Twin hose 302 connect manifold 512 to cooler unit 304, and the pump inside unit 304 circulates cooling liquid through the internal conduit of fitting 508. Thus, a user need not change from one tubehead to another in order to change from one type of cooling to another, need not stock two types of tubeheads, and can easily configure the system in the field for one type of cooling to another.

Although there should be no need for it, as each type of cooling should be sufficient for normal operation, the new arrangement of FIG. 5 can be used with both types of cooling simultaneously.

Thus, a portable industrial x-ray system is provided that that is conveniently field-configurable for gas or liquid cooling. The system comprises: (1) an elongated tubehead that at least partly encloses an x-ray tube having an anode emitting x-rays when energized; (2) a heat exchanger secured to the tubehead and comprising (a) a heat sink thermally coupled to the anode for heat exchange therewith and a fan which, when operating, supplies cooling gas to the heat radiating material to assist in cooling the anode and target, and (b) a fitting thermally coupled to the anode for heat exchange therewith and having an internal conduit in fluid flow communication with couplers for connection though a hose to an outside source of circulating liquid coolant; whereby a user configures the system for gas cooling only by operating the fan to cool the heat sink and thus the anode, or for liquid cooling only by keeping the fan off but operating the outside source to circulate liquid coolant through the internal conduit of the fitting and thereby cool the anode, or by operating both in gas cooled and liquid cooled modes. The improvement also includes the method of operating the same tubehead and heat exchanger either in only one of a gas heating mode and a liquid cooling mode, or in both modes.

The invention claimed is:

1. A portable industrial x-ray system conveniently field-configurable for gas or liquid cooling, comprising:

a. an elongated tubehead that at least partly encloses an x-ray tube having an anode emitting x-rays when energized;

b. a heat exchanger secured to the tubehead and comprising:

a heat sink, that selectively provides either gas cooling or liquid cooling, thermally coupled to the anode for heat exchange therewith;

a fan which, when operating, supplies gas to heat radiating material to assist in cooling the anode and a target; and a fitting thermally coupled to the anode for heat exchange therewith and having an internal conduit in fluid flow communication with couplers for connection though a hose to an outside source of circulating liquid coolant;

wherein the system selectively operates either (a) the fan to cool the heat sink and thus the anode by gas cooling, without liquid cooling, or (b) the outside source to circulate liquid coolant through the internal conduit of the fitting and thereby cool the anode by liquid cooling, without gas cooling.

2. A system as in claim 1, in which said heat sink is a finned heat sink.

3. A system as in claim 2 in which said conduit is secured to said heat sink.

4. A system as in claim 1, wherein during gas cooling the liquid coolant is not circulated through the internal conduit of the fitting, and during liquid cooling the fan off is maintained off.

5. A method of cooling a portable industrial x-ray system comprising a tubehead and a heat exchanger secured thereto, said tubehead including an x-ray tube having an anode emitting x-rays when energized, comprising:

a. providing in the heat exchanger both an air cooling arrangement thermally coupled with the anode and a liquid cooling arrangement thermally coupled with the anode; and b. selectively operating either the air cooling arrangement or the liquid cooling arrangement to cool the anode in operation of said x-ray tube.

6. The method of claim 5, further including:

maintaining said liquid cooling arrangement in a deactivated state during operation of said air cooling arrangement; and maintaining said air cooling arrangement in a deactivated state during operation of said liquid cooling arrangement.

* * * * *